US007516735B1

(12) United States Patent
Doherty et al.

(10) Patent No.: US 7,516,735 B1
(45) Date of Patent: Apr. 14, 2009

(54) ATTACHMENT FOR FUEL INJECTORS IN A FUEL DELIVERY SYSTEM

(75) Inventors: Robert Doherty, Syracuse, IN (US); Daniel Scott Edelman, Osceola, IN (US)

(73) Assignee: Millennium Industries, Auburn Hills, MI (US)

( * ) Notice: Subject to any disclaimer, the term of this patent is extended or adjusted under 35 U.S.C. 154(b) by 0 days.

(21) Appl. No.: 12/014,927

(22) Filed: Jan. 16, 2008

(51) Int. Cl.
*F02M 55/02* (2006.01)
*F02M 61/14* (2006.01)

(52) U.S. Cl. ..... 123/468; 123/469; 123/470

(58) Field of Classification Search ..... 123/468, 123/469, 470, 456
See application file for complete search history.

(56) References Cited

U.S. PATENT DOCUMENTS

| | | | | | |
|---|---|---|---|---|---|
| 4,133,565 | A * | 1/1979 | Shutt | 285/334.5 |
| 4,295,452 | A * | 10/1981 | Lembke et al. | 123/470 |
| 4,539,959 | A * | 9/1985 | Williams | 123/456 |
| 4,693,223 | A * | 9/1987 | Eshleman et al. | 123/468 |
| 4,705,306 | A * | 11/1987 | Guido et al. | 285/332 |
| 5,261,705 | A * | 11/1993 | Takahashi et al. | 285/197 |
| 5,286,070 | A | 2/1994 | Williams | |
| 5,765,534 | A * | 6/1998 | Brown et al. | 123/470 |
| 5,775,302 | A * | 7/1998 | Guido et al. | 123/468 |
| 5,957,507 | A | 9/1999 | Asada | |
| 5,979,945 | A | 11/1999 | Hitachi | |
| 5,992,904 | A | 11/1999 | Hitachi | |
| 6,045,162 | A | 4/2000 | Haibara | |
| 6,186,121 | B1 * | 2/2001 | Uematsu et al. | 123/468 |
| 6,318,341 | B1 * | 11/2001 | Gmelin et al. | 123/470 |
| 6,374,805 | B1 * | 4/2002 | Seymour et al. | 123/456 |
| 6,374,806 | B1 * | 4/2002 | Keeley et al. | 123/456 |
| 6,415,768 | B1 | 7/2002 | Usui | |
| 6,463,909 | B2 | 10/2002 | Asada | |
| 6,494,183 | B2 * | 12/2002 | Usui et al. | 123/456 |
| 6,543,421 | B2 * | 4/2003 | Lorraine et al. | 123/470 |
| 6,637,776 | B2 * | 10/2003 | Tikk et al. | 285/125.1 |
| 6,830,035 | B2 * | 12/2004 | Nishiwaki et al. | 123/470 |
| 6,848,424 | B2 * | 2/2005 | Watanabe | 123/456 |
| 6,874,477 | B1 * | 4/2005 | Lorraine et al. | 123/468 |
| 6,959,695 | B2 * | 11/2005 | Warner et al. | 123/456 |
| 7,114,489 | B2 | 10/2006 | Wenke | |
| 7,137,652 | B2 * | 11/2006 | Kondo et al. | 285/189 |
| 7,159,570 | B2 * | 1/2007 | Zdroik | 123/470 |
| 2001/0037796 | A1 * | 11/2001 | Lorraine et al. | 123/470 |
| 2004/0094127 | A1 * | 5/2004 | Watanabe | 123/447 |

* cited by examiner

*Primary Examiner*—Thomas N Moulis
(74) *Attorney, Agent, or Firm*—Dykema Gossett PLLC

(57) ABSTRACT

A fuel delivery system comprises a fuel rail having an inlet, an outlet and a receptor associated with the outlet. The system further comprises a fuel injector. The inlet of the injector is configured for communication with the outlet of the fuel rail, and the injector outlet is configured for communication with a combustion chamber of an engine. The system still further includes a first feature associated with on one of the fuel rail and the injector, and a second feature associated with the other of the fuel rail and injector. The first and second features cooperate to form a seal between the injector and the fuel rail, and to maintain the axial alignment of the components.

23 Claims, 4 Drawing Sheets

ATTACHMENT FOR FUEL INJECTORS IN A FUEL DELIVERY SYSTEM

FIELD OF THE INVENTION

The field of the present invention is fuel delivery systems. More particularly, the present invention relates to an arrangement for attaching one or more fuel injectors to a fuel rail in a gasoline direct injection fuel delivery system.

BACKGROUND OF THE INVENTION

Fuel delivery systems for direct injection applications, such as, for example, fuel-injected engines used in various types of on-road and off-road vehicles, typically include one or more fuel rails having a plurality of fuel injectors associated therewith. In such applications, the fuel rails may include a plurality of apertures in which injector sockets or cups are affixed. The fuel injectors are then inserted into and coupled with the injector cups so as to allow for the fuel flowing in the fuel rail to be communicated to the fuel injectors. The fuel communicated from the fuel rail to the fuel injectors is then communicated to the combustion chamber of the engine. Accordingly, in these arrangements the fuel injectors are sandwiched between the fuel rail and a corresponding cylinder head of the engine.

One drawback of such direct injected systems, however, is that the sandwiched arrangement of the fuel injector causes undesirable noise in the system. Prior attempts at eliminating or at least reducing this noise have included suspending the injector from the fuel rail. To do so, an O-ring seal and a fuel injector clip (due to the high pressure attendant in the system (i.e., on the order of 10 MPa or more)) are used to seal the connection between the fuel rail and fuel injector, and to hold and retain the injector in the correct position. Accordingly, the sealing and retention functions are performed separately. While such an arrangement may reduce the noise in the system, it requires additional components (e.g., the O-ring and the clip), which in turn increases both the weight and cost of the overall system and the corresponding manufacturing process.

Therefore, there is a need for a fuel delivery system that will minimize and/or eliminate one or more of the above-identified deficiencies.

SUMMARY OF THE INVENTION

The present invention is direct to a fuel delivery system. The inventive system comprises a fuel rail defining a first longitudinal axis and having an inlet, a feed outlet and a receptor associated with the feed outlet. The feed outlet defines a second axis extending therethrough that is perpendicular to the first longitudinal axis. The system further comprises a fuel injector having an inlet and an outlet. The inlet of the injector is configured for communication with the feed outlet of the fuel rail and the outlet of the injector is configured for communication with a combustion chamber of an engine associated with the system. The fuel injector further defines a third axis extending through the inlet and outlet thereof that is perpendicular to the first axis and substantially coaxial with the second axis. The inventive system still further includes a first feature disposed on one of the receptor and injector and a second feature disposed on the other of the receptor and injector. The first and second features cooperate to form a seal between the fuel injector and the receptor, and to maintain the axial alignment of the components. Additional apparatus corresponding to the inventive fuel delivery system and the constituent components thereof are also presented.

Further features and advantages of the present invention will become more apparent to those skilled in the art after a review of the invention as it is shown in the accompanying drawings and detailed description.

DETAILED DESCRIPTION OF PREFERRED EMBODIMENTS

Figure 1:
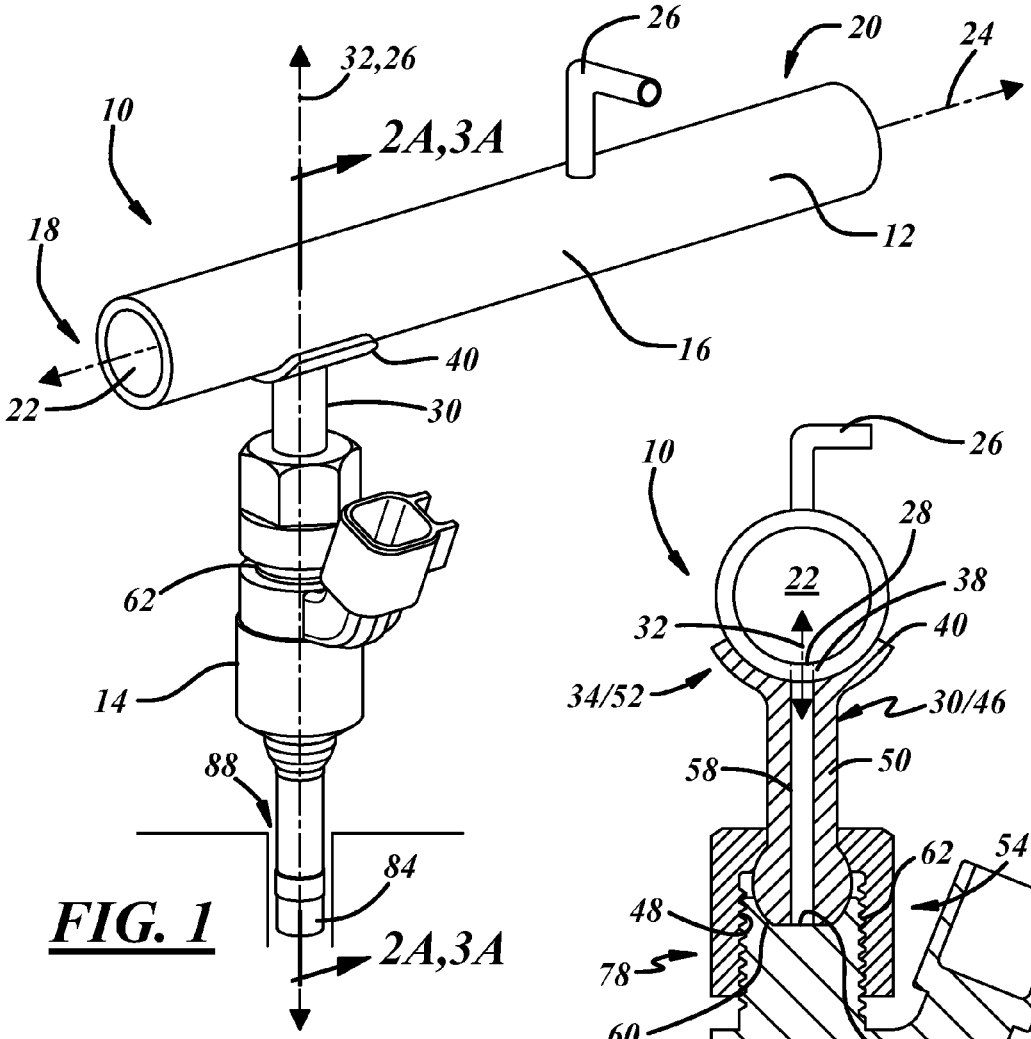
FIG. 1 is a perspective view of a fuel delivery system in accordance with the present invention.

Referring now to the drawings wherein like reference numerals are used to identify identical components in the various views, FIG. 1 illustrates one exemplary embodiment of a fuel delivery system 10. Fuel delivery system 10 generally includes a fuel rail 12 and a fuel injector 14.

As shown in FIG. 1, fuel rail 12 includes a body 16 having a first end 18, a second end 20 and a fluid passageway 22 extending therebetween. Body 16 further defines a longitudinal axis 24 extending therethrough from first end 18 through second end 20. In the illustrated exemplary embodiment, fuel rail 12 is of a one-piece construction having a circular cross-section. It should be noted, however, that the present invention is not meant to be so limited. Rather, in alternate embodiments, fuel rail 12 may be formed of multiple pieces and/or have a number of different cross-sectional shapes (e.g., rectangular, triangular, square, etc.). Additionally, in one embodiment, fuel rail 12 is formed of stainless steel; however, various other types of metals may be used, such as, for example, aluminum or an aluminum alloy. Alternatively, fuel rail 12 may be formed of a thermoplastic material, or a combination of metal and thermoplastic material (e.g., a polymer coated aluminum tube).

With continued reference to FIG. 1, fuel rail 12 further includes an inlet 26, at least one feed outlet 28 (best shown in FIGS. 2A and 3A) and at least one receptor 30 associated with feed outlet 28 that extends out and away from the outer surface of fuel rail 12 and that is configured to couple or mate fuel rail 12 with a fuel injector 14.

Inlet 26 is configured for connection to a fuel source (not shown), such as, for example, a fuel tank of a vehicle, in order to communicate fuel from the fuel source to fuel rail 12, and fluid passageway 22, in particular.

Feed outlet 28, which, in an exemplary embodiment, comprises an aperture in body 16 of fuel rail 12 and defines an axis 32 extending therethrough and perpendicular to axis 24 of fuel rail 12, is configured to be in fluid communication with the inlet of a corresponding fuel injector 14 to allow fuel in fuel rail 12 to be communicated to fuel injector 14, and ultimately, the engine associated with fuel delivery system 10. In an exemplary embodiment, fuel rail 12 includes a plurality of feed outlets 28 (and therefore, as will be described below, a corresponding number of receptors 30) so as to provide fuel to a number of corresponding fuel injectors 14. However, for the sake of simplicity alone, fuel delivery system 10 will be described hereinafter as having a single feed outlet 28, and therefore, a single fuel injector 14.

As briefly described above and with particular reference to FIGS. 2A and 2B, fuel delivery system 10 includes a receptor 30 associated with feed outlet 28. In an exemplary embodiment, receptor 30 is formed of the same material as fuel rail 12, and therefore, is constructed of stainless steel. As with fuel rail 12, however, the construction of receptor 30 is not limited to stainless steel. Rather, other suitable materials, metal (e.g., aluminum, aluminum alloys, etc.) or otherwise (e.g., thermoplastics, etc.), may be used in the construction of receptor 30. Receptor 30 includes a proximal end 34 located proximate to feed outlet 28, and a distal end 36 located out and away from rail 12. In one exemplary embodiment, receptor 30 further includes an opening 38 therein. Opening 38 is configured to be aligned with feed outlet 28 so that, as will be described in greater detail below, the fuel in passageway 22 can be communicated to the inlet of fuel injector 14 associated with receptor 30.

In an exemplary embodiment, receptor 30 is integrally formed with rail 12. However, in an alternate embodiment, receptor 30 is configured to be mounted or otherwise affixed to rail 12. In latter embodiment, receptor 30 may include a mounting flange 40 that may be affixed to rail 12 by way of conventional methods, such as, for example, brazing or welding processes. Although not necessarily required, in an exemplary embodiment, flange 40 is sized and shaped to match the particular contour of the outer surface of rail body 16. Accordingly, in an embodiment wherein fuel rail 12 has a circular cross-section, flange 40 has an arcuate shape. Alternatively, however, flange 40 may have a rectangular or square shape when fuel rail 12 has a corresponding rectangular or square cross-section. Accordingly, those of ordinary skill in the art will recognize that flange 40 may have many different shapes depending on the particular cross-section of rail 12. In an alternate exemplary embodiment, receptor 30 does not include flange 40, but rather is otherwise directly affixed to the outer surface of rail body 16 using known affixation methods (i.e., brazing, welding, and/or other suitable processes).

In addition to the components described above, and perhaps best shown in FIG. 4, fuel delivery system 10 further includes a first feature 42 associated with either one of fuel injector 14 and fuel rail 12 (and receptor 30 thereof, in particular), and a second feature 44 associated with the other one of fuel injector 14 and fuel rail 12. First and second features 42, 44 are complementary to each other and are configured to create a seal between fuel rail 12 and fuel injector 14, as well as to couple and retain fuel rail 12 and fuel injector 14 together.

Figure 2A:
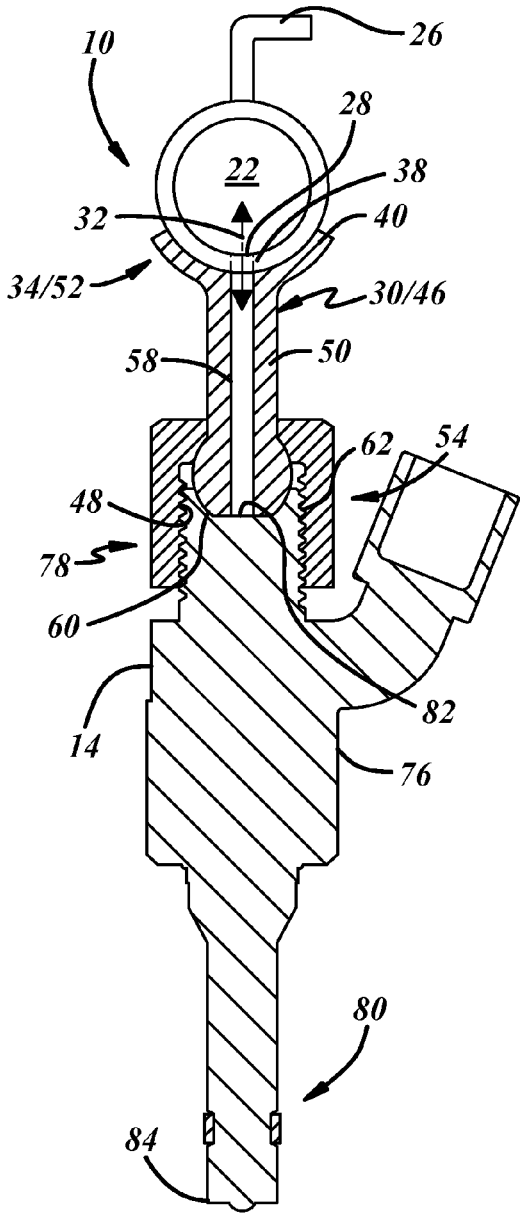
FIG. 2A is a side cross-section view of the fuel delivery system of FIG. 1 taken along lines 2-2 of FIG. 1.
Figure 3A:
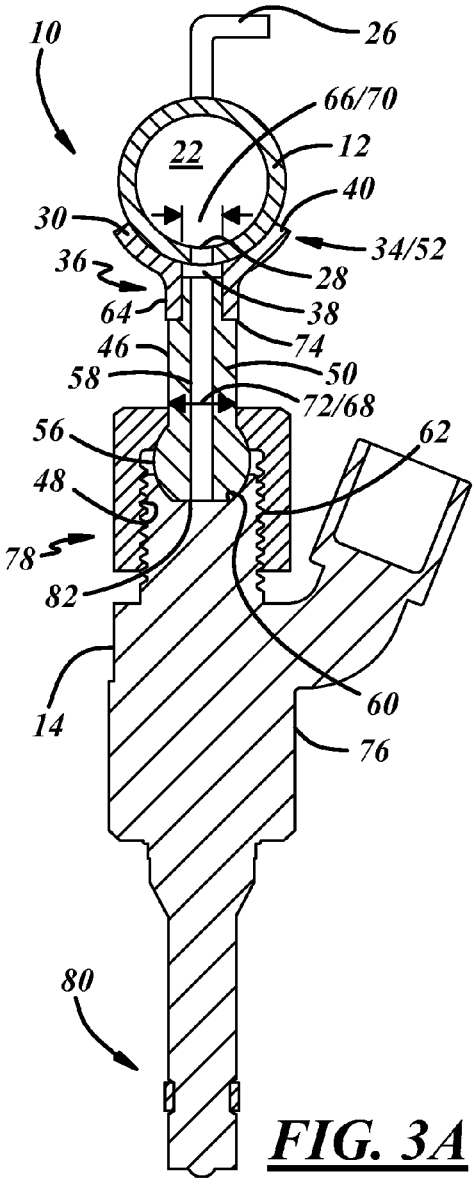
FIG. 3A is a side cross-section view of an alternate exemplary embodiment of the fuel delivery system illustrated in FIG. 1.
Figure 4:
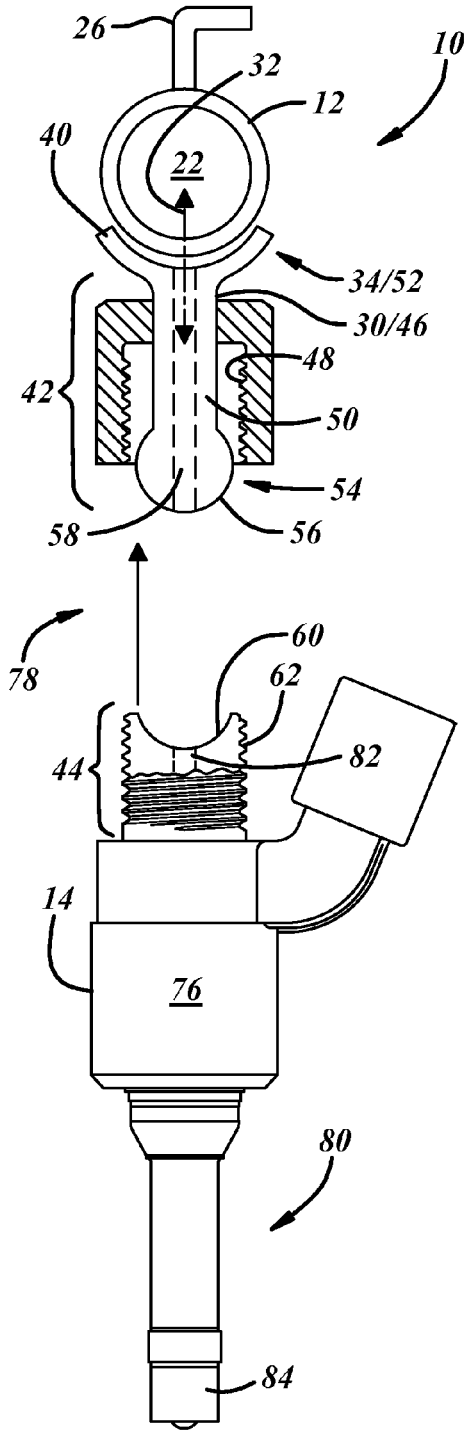
FIG. 4 is an exploded view of the fuel delivery system illustrated in FIGS. 1-3B.

In an exemplary embodiment illustrated, for example, in FIGS. 2A, 3A, and 4, first feature 42 includes a fuel injector supporting member 46 and a threaded portion 48. Supporting member 46, which may be formed of any number of materials, such as, for example, stainless steel, aluminum, thermoplastics, or other suitable materials, includes a shaft portion 50, which, in turn, includes a proximal end 52 and a distal end 54. As will be described in greater detail below, the outer surface of distal end 54 comprises an engagement surface 56. In an exemplary embodiment, distal end 54 has a spherical shape, and thus, engagement surface 56 also has a spherical shape. It should be noted, however, that shaft 50 is not limited to a spherically shaped distal end; but rather, in alternate embodiments, distal end 54 may have any number of size and shapes. Accordingly, the present invention is not meant to be limited to distal end 54 having a spherical shape. As depicted in FIG. 2A, and for reasons more fully described below, supporting member 46 further includes a channel 58 extending through shaft 50 from proximal end 52 to distal end 54.

With continued reference to FIG. 2A, in the illustrated embodiment, threaded portion 48 comprises a threaded nut that circumscribes and is slidable along and rotatable about supporting member 46, and shaft 50 thereof, in particular. The nut (i.e., threaded portion 48 of first feature 42) is retained on shaft 50 by distal end 54, and so in the illustrated embodiment, by spherically-shaped distal end 54. Accordingly, the nut is prevented from sliding off of supporting member 46 by distal end 54.

In an exemplary embodiment, second feature 44 includes a seat 60 and a threaded portion 62. As briefly described above, first and second features 42, 44 are complementary with each other. Accordingly, seat 60 is sized and shaped to receive distal at least a portion of distal end 54, and threaded portion 62 is configured to mate with threaded portion 48 of first feature 42. More particularly, threaded portion 62 of second feature 44 is configured to be mated with the inner threaded surface of the nut comprising threaded portion 48 so as to create a compression fitting therebetween.

FIGS. 2A-4, illustrate an exemplary embodiment of fuel delivery system 10 wherein first feature 42 is associated with receptor 30 and second feature 44 is associated with injector 14.

Figure 2B:
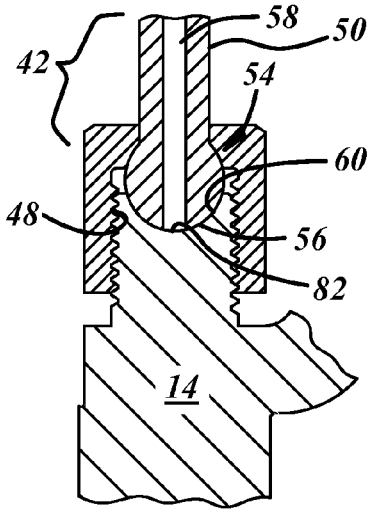
FIG. 2B is an enlarged portion of the fuel delivery system of FIG. 2B.

In the particular embodiment illustrated in FIGS. 2A and 2B, supporting member 46 of first feature 42 and receptor 30 are integrally formed together. Therefore, rather than being separate and distinct components, as is the case in the embodiment illustrated in FIG. 3A and described below, receptor 30 and supporting member 46 are of a unitary construction. In this embodiment, opening 38 in receptor 30 and channel 58 in supporting member 46 are combined as one such that there is a single channel extending through the entire length of the receptor 30/supporting member 46 combination. Accordingly, as described above with respect to opening 38, when assembled with fuel rail 12, the combination of channel 58/opening 38 is aligned with feed outlet 28 such that fuel can be communicated between fuel rail 12 and an injector associated with the combined receptor 30/supporting member 46 structure. As depicted in FIG. 2A, in this embodiment, flange 40 is configured mount the combination of receptor 30 and supporting member 46 to fuel rail body 16. Additionally, because first feature 42 is associated with receptor 30, the nut comprising the threaded portion 48 of first feature 42 is also associated with receptor 30, and is configured to slide along shaft 50 of first feature 42 from receptor 30 to distal end 54 of shaft 50.

Figure 3B:
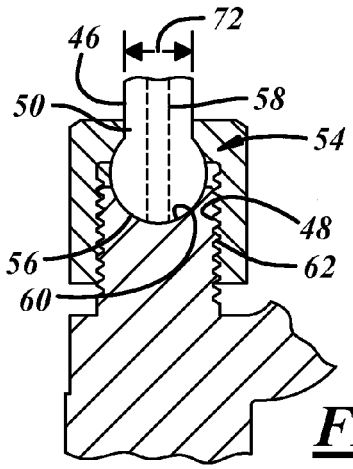
FIG. 3B is an enlarged portion of the fuel delivery system of FIG. 3A.

In an alternate embodiment illustrated in FIG. 3A, receptor 30 and supporting member 46 of first feature 42 are separate and distinct components. In this embodiment, in addition to opening 38 and flange 40, receptor 30 includes a cup portion 64 that is integral with flange 40 and that has an inner diameter 66 and an outer diameter 68 that is greater than inner diameter 66. As illustrated in FIGS. 3A and 3B, a first portion of shaft 50 at proximal end 52 thereof has an outer diameter 70 that is substantially equal to inner diameter 66 of cup 64. A second portion of shaft 50 has a second outer diameter 72 that is greater than first diameter 70 and substantially equal to the outer diameter 68 of cup 64. Accordingly, the reduced diameter portion of shaft 50 is sized and shaped so as to be inserted into and received by cup portion 64. When shaft 50 is inserted into cup 50, outlet 28, opening 38, and channel 58 are all aligned such that the fuel in fuel rail 12 can be communicated from fuel passageway 12 to the injector associated with supporting member 46. With continued reference to FIG. 3A, shaft 50 further includes a shoulder 74 disposed at the point on shaft 50 where the diameter thereof changes from first diameter 70 to second diameter 72. Shoulder 74 is configured to abut and engage the outer rim of cup portion 64 once shaft 50 is inserted into cup 64. During the assembly process of this embodiment of fuel delivery system 10, the contact region between shoulder 74 and the rim of cup portion 64 is brazed or welded together using known processes to seal the joint therebetween. In an exemplary embodiment, this brazing/welding process is done at the same time flange 40 is brazed/welded to fuel rail body 16. However, in alternate embodiments, shaft 50 is affixed to cup 64 prior to or following the affixation of flange 40 to fuel rail 12. Additionally, because first feature 42 is associated with receptor 30, the nut comprising the threaded portion 48 of first feature 42 is also associated with receptor 30, and is configured to slide along shaft 50 of first feature 42 from receptor 30 to distal end 54 of shaft 50. Accordingly, other than being separate components that are assembled together, this embodiment of receptor 30 and first feature 42 is the same as the embodiment wherein supporting member 46 of first feature 42 is integrally formed with receptor 30.

Regardless of how first feature 42 and receptor 30 are associated together, in this embodiment, second feature 44 is associated with injector 14. As illustrated in FIG. 4, injector 14 includes a body 76, a first end 78, and a second end 80 opposite first end 78. Injector 14 further includes an inlet 82 disposed at first end 78, an outlet 84 disposed at second end 80, and defines a longitudinal axis 86 extending through inlet 82 and outlet 84. As briefly described above, second feature 44 includes a seat 60 and a threaded portion 62. In this embodiment, seat 60 and threaded portion 62 are both formed/disposed in injector body 76 at first end 78. More particularly, seat 60 is disposed in such a location that inlet 82 is disposed within seat 60. Inlet 82 is configured to be in fluid communication with feed outlet 28 of fuel rail 12, and therefore channel 58 of shaft 50, such that fuel in passageway 22 can be communicated to injector 14. Accordingly, as will be described in greater detail below, when fuel delivery system 10 is assembled, inlet 82 is axially aligned and in fluid communication with both feed outlet 28 and channel 58 (axes 32 and 86 are substantially coaxial). Fuel injector outlet 84, on the other hand, is configured for communication with a combustion chamber 88 of an engine associated with fuel delivery system 10 (See FIG. 1). Accordingly, outlet 84 communicates fuel received at inlet 82 to combustion chamber 88. In an assembled state, therefore, axis 86 of injector 14 is perpendicular to axis 24 of fuel rail 12, and parallel and substantially coaxial with axis 32. Thus, fuel injector 14 is axially aligned with both combustion chamber 88 and feed outlet 28.

Figure 5:
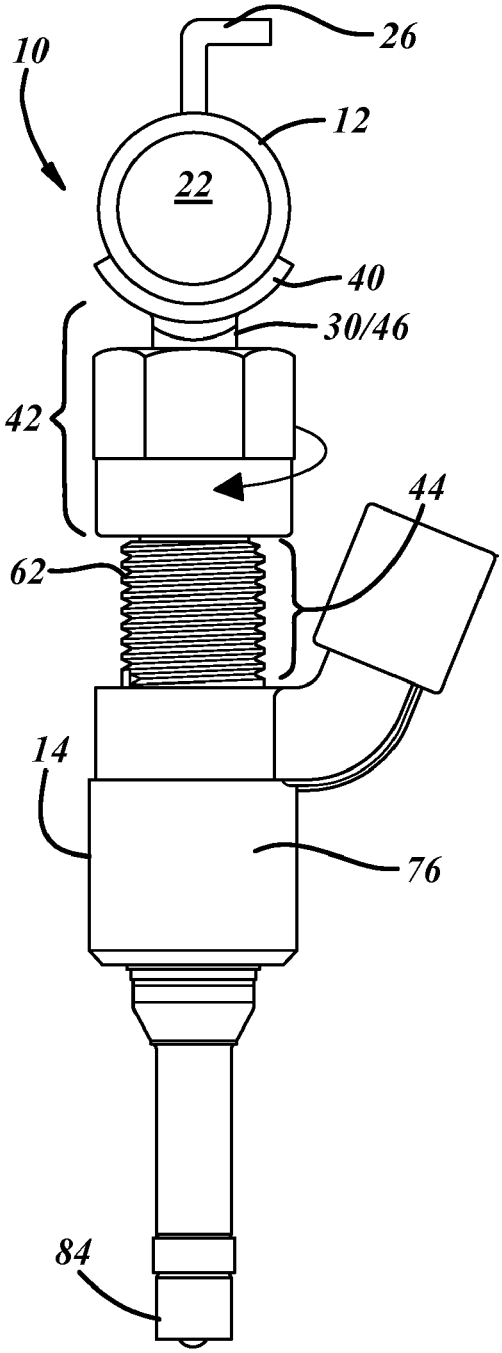
FIG. 5 is a side elevational view of the fuel delivery system of FIG. 1 during an initial stage of assembly.
Figure 6:
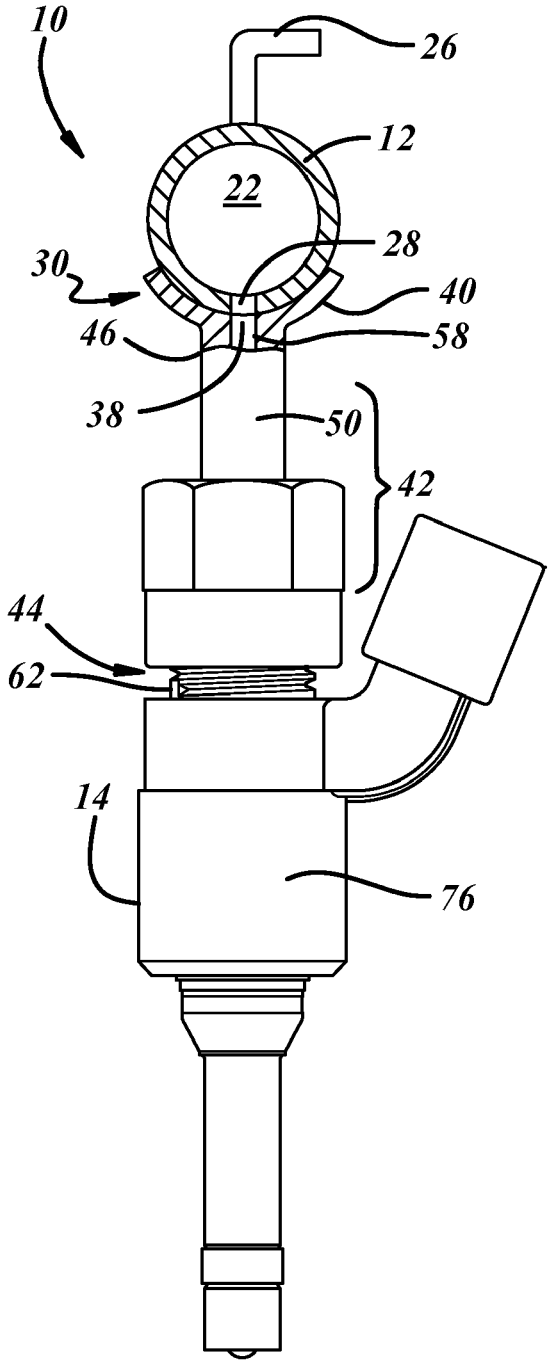
FIG. 6 is a side elevational view of the fuel delivery system of FIG. 1 in a final assembled state.

With reference to FIGS. 4-6, the assembly of the aforedescribed embodiments of fuel delivery system 10 and the mating of first and second features 42, 44 will be described. First, if appropriate, receptor 30 and supporting member 46 of first feature 42 are assembled together and mounted to fuel rail body 12. Next, seat 60 of second feature 44 is aligned with injector supporting member 46, and distal end 54 thereof, in particular, (best shown in FIG. 4). As briefly described above, seat 60 is complementary to the shape of distal end 54. The size and shape of seat 60 is dependent upon the size and shape of distal end 54, and vice versa. Therefore, seat 60 is sized and shaped to receive at least a portion of distal end 54, and to engage engagement surface 56 thereof. Accordingly, in the embodiment illustrated in FIG. 4 wherein distal end 54 of supporting member 46 has a spherical shape, seat 60 has a complementary conical shape. In such an embodiment, seat 60 has substantially the same diameter as spherically shaped distal end 54 such that there is a tight fit between engagement surface 56 and the inner surface of conical seat 60, and also a constant line of contact along substantially the entire surface of conical seat 60.

With continued reference to FIGS. 4-6, once seat 60 is aligned with supporting member 46 such that injector inlet 82 is aligned with channel 58, injector 14 is engaged/coupled with injector supporting member 46. With reference to FIGS. 5 and 6, once injector 14 and supporting member are properly engaged/coupled, the nut comprising threaded portion 48 of first feature 42 is then slid down to distal end 54 of supporting member 46 and threaded onto threaded portion 62 of second feature 44. When the respective threaded portions 48, 62 of first and second features 42, 44 are mated together, first and second features 42, 44 cooperate to suspend injector 14 from fuel rail 12 such that injector 14 is not sandwiched between fuel rail 12 and a corresponding cylinder head of an engine. Additionally, the combination of the close-fit engagement between spherically shaped distal end 54 and seat 60, and the mating of threaded portions 48, 62 further serves to create a tight seal between injector 14 and fuel rail 12, and a rigid connection therebetween.

While the description set forth above provides that first feature 42 is associated with receptor 30 and second feature 44 is associated with injector 14, one of ordinary skill in the art will recognize and appreciate that the features may be reversed such that first feature 42 is associated with injector 14, while second feature 44 is associated with receptor 30. More particularly, in an alternate embodiment, receptor 30 is formed to have seat 60 disposed therein and also to have a threaded surface 62 proximate seat 60. In this embodiment, opening 38 of receptor 30 extends into seat 60. On the other hand, in this embodiment, injector 14 includes supporting member 46 and threaded portion 48 disposed at first end 78 thereof proximate injector inlet 82. Accordingly, as described above, seat 60, now part of receptor 30, is configured to receive distal end 54 of supporting member 46, now associated with injector 14; and the nut, now associated with injector 14, is configured to be threaded onto threaded portion 62, now disposed on receptor 30. Therefore, first and second portions 42, 44 may be alternatively associated with either injector 14 or receptor 30, and thus, the description set forth above relating to first and second features 42, 44 and the constituent parts thereof applies to this embodiment with equal force.

Accordingly, in the exemplary embodiments described above wherein first and second features 42, 44 have complementary threaded portions, the mating of these portions create a compression fitting that serves to seal the coupling of fuel injector 14 and receptor 30, to reinforce the suspension of fuel injector 14, and to retain injector 14 in place in axial alignment with both fuel rail outlet 28 and combustion chamber 88. The axial alignment and the mating of features 42, 44 serve a number of purposes. First, when in axial alignment, injector outlet 84 engages the cylinder head and reaches the combustion chamber 88, which forces injector 14 into rigid alignment. Second, in a normal O-ring type joint, if the connection to fuel rail 12 is misaligned, injector side loading may result. This is due to the load applied to the fuel rail and injector as a result of the high pressure in the system (i.e., on the order of 10 MPa), which may cause the injector to want to "pop out" of the injector cup unless firmly secured to the cup/rail. Additionally, a load created by the combustion pressure resulting from a combustion event occurring in combustion chamber 88 is applied substantially coincident to axis 86 of injector 14 (and, therefore, normal to axis 24 of rail 12) and can have the effect of causing a moment, such as a twisting moment, to be applied to injector 14 and/or fuel rail 12. Accordingly, the axial alignment combined with the rigid connection and seal formed by first and second features 42, 44 serves to prevent such occurrences, while also allowing some measure of misalignment.

It should be noted that while the only embodiment of first and second features 42, 44 that was described above in detail was one in which first and second features 42, 44 have threaded portions, the present invention is not meant to be so limited. Rather, other configurations and/or arrangements exist that may be implemented. For example, in one alternate exemplary embodiment, fuel injector 14 can be affixed to receptor 30 or fuel rail 12 using a brazing or welding technique. In such an embodiment, first and second features 42, 44 comprise complementary flanges that can be welded or brazed together, for example. Accordingly, those of ordinary skill in the art will recognize that other arrangements and configurations exist that can be implemented to carry out the same function and purpose described above.

Figure 7:
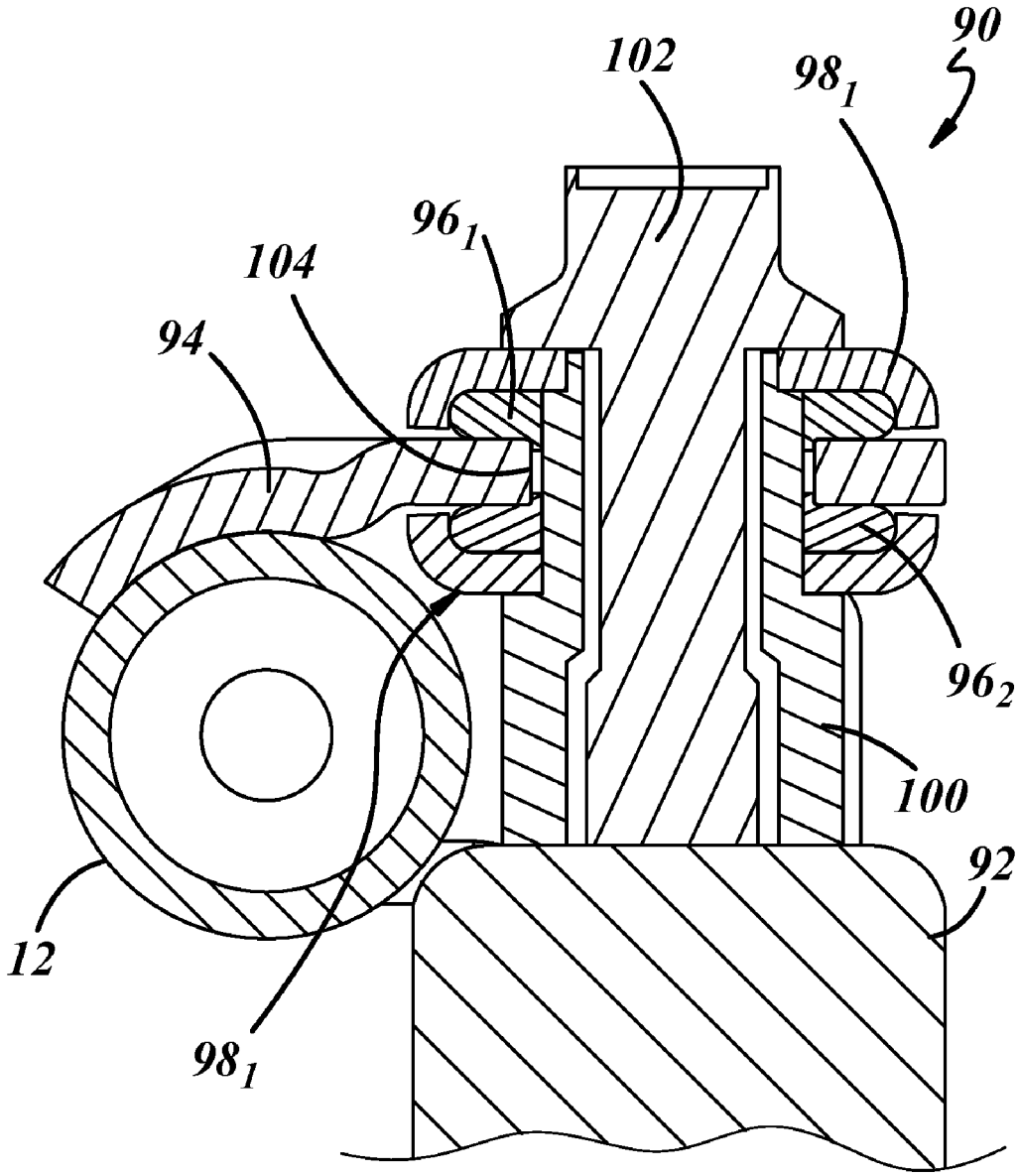
FIG. 7 is a perspective view of a mounting arrangement for the fuel delivery system illustrated in FIG. 1.

In an exemplary embodiment illustrated in FIG. 7, fuel delivery system 10 further comprises at least one force resolving mount 90. Force resolving mount 90 is configured for mounting fuel rail 12 to a reaction surface 92, such as, for example, the cylinder head, intake manifold, or any other surface in the engine compartment proximate fuel rail 12 that is suitable for mounting fuel rail 12 thereto. In an exemplary embodiment, system 10 includes the same number of mounts 90 as injectors 14 (e.g., if the engine is an eight-cylinder engine, there will be eight injectors and eight mounts).

In an exemplary embodiment, mount 90 is comprised of the combination of a mounting bracket 94, one or more elastomer isolators 96, one or more washers 98, a compression limiter 100 and a bolt 102. As illustrated in FIG. 7, bracket 94 is affixed to rail 12 by conventional means (e.g., welding, brazing, etc.), and has an aperture 104 therein, for reasons that will be described in greater detail below. In the illustrated embodiment, a first washer $\mathbf{98}_1$ is disposed on top of bracket 94, and a second washer $\mathbf{98}_2$ is disposed below bracket 94. In between the top of bracket 94 and washer $\mathbf{98}_1$ is a elastomer isolator $\mathbf{96}_1$, and a second elastomer isolator $\mathbf{96}_2$ is disposed in between the bottom of bracket 94 and isolator $\mathbf{96}_2$. Each of washers $\mathbf{98}_1$, $\mathbf{98}_2$ and isolators $\mathbf{96}_1$, $\mathbf{96}_2$ also have apertures therein that are coaxial with aperture 104 of bracket 94. Compression limited 84 is aligned with aperture 104, and is configured to receive bolt 102. Accordingly, bolt 102 is inserted into the apertures in the washers, isolators and bracket, and is screwed into compression limiter 100 before reaching mounting surface 92.

In operation, elastomer isolators $\mathbf{96}_1$, $\mathbf{96}_2$ serve to allow rail 12 to "float" rather than to be hard mounted. Washers $\mathbf{98}_1$, $\mathbf{98}_2$ are provided so that in the event the full pressure of the system forces the rail up or down, washers $\mathbf{98}_1$, $\mathbf{98}_2$ limited the amount of movement. Compression limiter 100 serves as a mounting surface for bolt 102 and is provided to prevent bolt 102 from being over-tightened, which could damage the elastomer isolators, as well as to limit the movement of washers $\mathbf{98}_1$, $\mathbf{98}_2$. It should be noted, however, that the present invention is not limited to such a mounting arrangement. Those of ordinary skill in the art will recognize that other components and arrangements exist that may serve the same function and purpose of the mounting arrangement described above. For example, in alternate embodiments, grommets, damping springs, displacement limiters, or any combination of any of the above may be used in place of those components described above. Accordingly, when fuel rail 12 is mounted, the force applied by the loads created by the various pressures attendant in the system may be transferred from the injector/fuel rail combination, through force resolving mount 90, and then onto the reaction surface 92 to dissipate this pressure/force.

While the invention has been particularly shown and described with reference to the preferred embodiments thereof, it is well understood by those skilled in the art that various changes and modifications can be made in the invention without departing from the spirit and scope of the invention.

The invention claimed is:

1. A fuel delivery system, comprising:

a fuel rail defining a first longitudinal axis and having an inlet, a feed outlet and a receptor associated with said feed outlet, said feed outlet defining a second axis extending therethrough that is perpendicular to said first longitudinal axis;

a fuel injector having an inlet and an outlet, said inlet configured for communication with said feed outlet and said outlet configured for communication with a combustion chamber of an engine associated with said system, said fuel injector defining a third axis extending through said inlet and said outlet thereof that is perpendicular to said first axis and substantially coaxial with said second axis;

a first feature associated with one of said fuel rail and said injector, and a second feature associated with the other of said fuel rail and injector, wherein said first and second features cooperate to couple said fuel injector and said fuel rail together and to form a seal therebetween; and a force resolving mount configured for mounting said fuel rail to a reaction surface, said force resolving mount configured to prevent the application of a moment on said fuel rail and said fuel injector about said respective first and third axes as a result of loads applied thereto by pressure in said system, wherein said force resolving mount comprises:

a mounting bracket affixed to said fuel rail and having an aperture therein configured to receive a mounting bolt;

a first washer disposed on top of said bracket and a second washer disposed on the bottom of said bracket, each of said first and second washers having an aperture therein that is substantially co-axial with said aperture in said bracket and also configured to receive said mounting bolt;

a first elastomer isolator disposed between said first washer and said bracket, and a second elastomer isolator disposed between said second washer and said bracket, wherein each of said first and second elastomer isolators have an aperture therein that is substantially co-axial with said apertures in said bracket and said first and second washers and also configured to receive said mounting bolt;

a compression limiter configured to receive said mounting bolt and to limit the compression applied by said mounting bolt.

2. A fuel delivery system, comprising:

a fuel rail defining a first longitudinal axis and having an inlet, a feed outlet and a receptor associated with said feed outlet, said feed outlet defining a second axis extending therethrough that is perpendicular to said first longitudinal axis;

a fuel injector having an inlet and an outlet, said inlet configured for communication with said feed outlet and said outlet configured for communication with a combustion chamber of an engine associated with said system, said fuel injector defining a third, axis extending through said inlet and said outlet thereof that is perpendicular to said first axis and substantially coaxial with said second axis; and a first feature associated with one of said fuel rail and said injector, and a second feature associated with the other of said fuel rail and injector, wherein said first and second features cooperate to couple said fuel injector and said fuel rail together and to form a seal therebetween, wherein:

said first feature further comprises a fuel injector supporting member and a threaded nut, said supporting member including a shaft having a proximal end and a distal end, and said nut circumscribing said shaft and being rotatable about and slidable along the length of said shaft, the threaded interior surface of said nut comprising said threaded portion of said first feature;

said second feature further comprises a seat located proximate said threaded portion of said second feature and configured to receive a portion of said distal end of said supporting member, and said first and second features comprise complementary threaded portions configured to be mated together to form a compression fitting.

3. A fuel delivery system in accordance with claim 2 wherein said receptor is affixed to said fuel rail.

4. A fuel delivery system in accordance with claim 2 wherein said receptor is integrally formed with said fuel rail.

5. A fuel delivery system in accordance with claim 2 wherein said first feature is associated with said receptor of said fuel rail and said second feature is associated with said fuel injector, and further wherein said seat and said threaded portion of said second feature are disposed in the body of said fuel injector proximate said injector inlet.

6. A fuel delivery system in accordance with claim 5 wherein said supporting member of said first feature is integrally formed with said receptor.

7. A fuel delivery system in accordance with claim 5 wherein said supporting member is distinct from said receptor and is configured to be affixed thereto.

8. A fuel delivery system in accordance with claim 2 wherein said second feature is associated with said receptor of said fuel rail and said first feature is associated with said fuel injector, and further wherein said seat and said threaded portion of said second feature are disposed in said receptor.

9. A fuel delivery system in accordance with claim 2 wherein said distal end of said supporting member has a spherical shape, and said seat of said second feature has a complementary conical shape.

10. A fuel injector, comprising:

an inlet configured for fluid communication with a feed outlet of a fuel rail;

an outlet configured communication with a combustion chamber of an engine;

a body disposed between said inlet and said outlet; and a first feature including a seat formed in said body proximate said inlet and a threaded portion formed in said body proximate said seat, said body and said seat configured to receive a complementary portion of a second feature associated with said fuel rail and said threaded portion configured to mate with a complementary threaded portion of said second feature.

11. A fuel injector in accordance with claim 10 wherein said seat has a conical shape configured to receive a complementary spherically shaped portion of said second feature.

12. A fuel injector in accordance with claim 10 wherein a portion of the outer surface of said injector body is threaded and comprises said threaded portion of said first feature.

13. A fuel injector, comprising:

an inlet configured for fluid communication with a feed outlet of a fuel rail;

an outlet configured communication with a combustion chamber of an engine;

a body disposed between said inlet and said outlet; and a first feature proximate said inlet, a portion of said first feature configured to be mated with a seat of a second feature associated with said fuel rail, said first feature including a threaded portion configured for mating with a complementary threaded portion of said second feature, wherein said threaded portion of said first feature comprises a threaded nut.

14. A fuel rail, comprising:

a body having a first end, a second end and a fluid passageway extending therebetween, said body defining a first longitudinal axis;

an inlet in said body configured for communication with a fuel source such that fuel can be communicated from said fuel source to said fluid passageway;

a feed outlet in said body configured for communication with the inlet of a corresponding fuel injector to allow for fuel in said passageway to be communicated to said fuel injector, said outlet defining a second axis extending therethrough that is perpendicular to said first longitudinal axis;

a receptor located proximate said feed outlet configured to allow for the axial alignment of said fuel injector with said feed outlet; and a first feature associated with said receptor including a threaded portion configured for mating with a complementary threaded portion of a second feature associated with said fuel injector, and a fuel injector supporting member having a distal end configured for mating with a seat in said fuel injector, wherein said threaded portion of said first feature comprises a threaded nut circumscribing said supporting member that is rotatable about and slidable along the length of said supporting member.

15. A fuel rail in accordance with claim 14 wherein said distal end of said supporting member has a spherical shape and said seat has a complementary conical shape.

16. A fuel rail, comprising:

a body having a first end, a second end and a fluid passageway extending therebetween, said body defining a first longitudinal axis;

an inlet in said body configured for communication with a fuel source such that fuel can be communicated from said fuel source to said fluid passageway;

a feed outlet in said body configured for communication with the inlet of a corresponding fuel injector to allow for fuel in said passageway to be communicated to said fuel injector, said outlet defining a second axis extending therethrough that is perpendicular to said first longitudinal axis;

a receptor located proximate said feed outlet configured to allow for the axial alignment of said fuel injector with said feed outlet; and a first feature associated with said receptor including a threaded portion configured for mating with a complementary threaded portion of a second feature associated with said fuel injector, and a seat formed in said receptor, wherein said threaded portion of said first feature is formed in the outer surface of said receptor proximate said seat.

17. A fuel rail in accordance with claim 14 wherein said supporting member of said first feature is integrally formed with said receptor.

18. A fuel rail in accordance with claim 14 wherein said supporting member is distinct from said receptor and is configured to be affixed thereto.

19. A fuel delivery system rail, comprising:

a body having a first end, a second end and a fluid passageway extending therebetween, said body defining a first longitudinal axis;

an inlet in said body configured for communication with a fuel source such that fuel can be communicated from said fuel source to said fluid passageway;

a feed outlet in said body configured for communication with the inlet of a corresponding fuel injector to allow for fuel in said passageway to be communicated to said fuel injector, said outlet defining a second axis extending therethrough that is perpendicular to said first longitudinal axis;

a receptor located proximate said feed outlet configured to allow for the axial alignment of said fuel injector with said feed outlet;

a first feature associated with said receptor including a threaded portion configured for mating with a complementary threaded portion of a second feature associated with said fuel injector; and a force resolving mount configured for mounting said fuel rail to a reaction surface, wherein said force resolving mount comprises:

a mounting bracket affixed to said fuel rail and having an aperture therein configured to receive a mounting bolt;

a first washer disposed on top of said bracket and a second washer disposed on the bottom of said bracket, each of said first and second washers having an aperture therein that is substantially co-axial with said aperture in said bracket and also configured to receive said mounting bolt;

a first elastomer isolator disposed between said first washer and said bracket, and a second elastomer isolator disposed between said second washer and said bracket, wherein each of said first and second elastomer isolators have an aperture therein that is substantially co-axial with said apertures in said bracket and said first and second washers and also configured to receive said mounting bolt;

a compression limiter configured to receive said mounting bolt and to limit the compression applied by said mounting bolt.

20. A fuel rail in accordance with claim 14 wherein said receptor is affixed to said body.

21. A fuel rail in accordance with claim 14 wherein said receptor is integral to said body.

22. A fuel rail in accordance with claim 16 wherein said receptor is affixed to said body.

23. A fuel rail in accordance with claim 16 wherein said receptor is integral to said body.

* * * * *